United States Patent [19]

Felici et al.

[11] 4,039,145

[45] Aug. 2, 1977

[54] ELECTROSTATIC POWDERING NOZZLE

[75] Inventors: Noel Felici; Elie Gartner, both of Grenoble, France

[73] Assignee: Air-Industrie, Courbevoie, France

[21] Appl. No.: 599,781

[22] Filed: July 28, 1975

[30] Foreign Application Priority Data

Sept. 6, 1974 France ..... 74.30686

[51] Int. Cl.[2] ..... B05B 5/02

[52] U.S. Cl. ..... 239/15; 239/145

[58] Field of Search ..... 239/3, 15, 145; 313/357

[56] References Cited

U.S. PATENT DOCUMENTS

| | | | |
|---|---|---|---|
| 3,290,169 | 12/1966 | Sedlacsik, Jr. | 239/15 X |
| 3,516,608 | 6/1970 | Bowen et al. | 239/15 |
| 3,521,125 | 7/1970 | Nelson | 239/15 X |
| 3,550,852 | 12/1970 | Wallis | 239/15 |
| 3,578,997 | 5/1971 | Felici | 239/15 X |
| 3,587,967 | 6/1971 | Badger | 239/15 |
| 3,698,635 | 10/1972 | Sickles | 239/15 |
| 3,735,925 | 5/1973 | Benedek | 239/15 |
| 3,826,425 | 7/1974 | Scharfenberger et al. | 239/15 |
| 3,940,061 | 2/1976 | Gimple et al. | 239/15 |

FOREIGN PATENT DOCUMENTS

| | | | |
|---|---|---|---|
| 6,933,925 | 10/1969 | Germany | |
| 45-36115 | 11/1970 | Japan | 239/145 |
| 918,880 | 2/1963 | United Kingdom | 313/357 |

*Primary Examiner*—John J. Love

*Attorney, Agent, or Firm*—Brisebois & Kruger

[57] ABSTRACT

An electrostatic powdering nozzle comprising means for avoiding the fixing of powder particles on at least one of the electrodes, the said means consisting either in constructing at least one of the said electrodes in graphite or silicon, or in constructing at least one of these electrodes in electrically conductive porous material and in blowing a stream of gas through this or these electrodes.

3 Claims, 3 Drawing Figures

ELECTROSTATIC POWDERING NOZZLE

The present invention relates to a nozzle for the electrostatic spraying of solid powder products or similar products, such as, for example, organic or mineral powders.

Most of the devices for electrostatic powder-coating known at present, such as, for example, the manual guns marketed under the trademark "STAJET", need a very high voltage, generally between 60 and 90 kilovolts, which is applied between one or several electrodes placed at the end of the gun, and the object to be coated, which is generally earthed.

Such devices function perfectly, but require nevertheless a generator of very high voltage, which, in certain cases, it is preferable to avoid for practical reasons. Another drawback of such devices lies in the fact that because of the rise in temperature of the electrodes at a very high voltage, the particles of plastic powder which come into contact with these electrodes may melt or polymerize on the latter, thus rapidly forming an insulating film. Such an insulating film causes on the one hand poor functioning of the gun and on the other, a risk of fire which could be brought about by a spark following a breakdown through the said film. Such a film may likewise be produced, with other sorts of powders, by these being deposited on the said electrodes.

Consequently it was thought of using electrostatic powder-coating devices functioning at a much lower particle charging voltage, of about ten kilovolts. A satisfactory charge of the particles can only be obtained, with such voltages, by means of electric charging devices such as those formerly devised by Messrs. Truffaut and Hampe for crop spraying. Such charging devices comprise, generally speaking, a first axial electrode brought to high voltage and surrounded by an earthed second electrode, the so-called counter-electrode, or vice versa.

Unfortunately, the devices invented by Messrs. Truffaut and Hampe cannot be directly used for coating objects with plastic powder, for example. Indeed, as a result of the electrical functioning itself of the device, and in spite of the air flow carrying along the powder, a fraction of the latter, by the effect of the radial electric field, is swept on to the counter-electrode. These particles may, because of the friction, be melted or polymerized, thus creating an insulating film which prevents ionization of the air. Such an insulating film may also come about with other sorts of powder.

To avoid the formation of an insulating film on the internal surface of the annular counter-electrode, it has been thought of protecting the said internal surface, as, for example, in U.S. Pat. No. 3,516,608, by a curtain of auxiliary air, obtained by the air being blown along the inside surface of the said counter-electrode, and parallel to it. Such a proceeding did not, however, prove satisfactory, since it did not increase substantially the time during which the nozzle functioned correctly.

The nozzle according to the invention makes it possible to avoid the drawbacks previously cited, and consequently to produce an electrostatic powder-coating nozzle giving an acceptable electrostatic effect, without risk of any insulating film forming on at least one electrode. It is characterized in that it comprises means for avoiding the fixing of powder particles on at least one of the electrodes, the said means consisting either in constructing at least one of said electrodes in graphite or silicon, or in constructing at least one of these electrodes in electrically conductive porous material and in blowing a stream of gas through this or these electrodes.

The invention will be made clearer in the following description of three preferred embodiments, referring to the attached drawings, in which.

Figure 1:
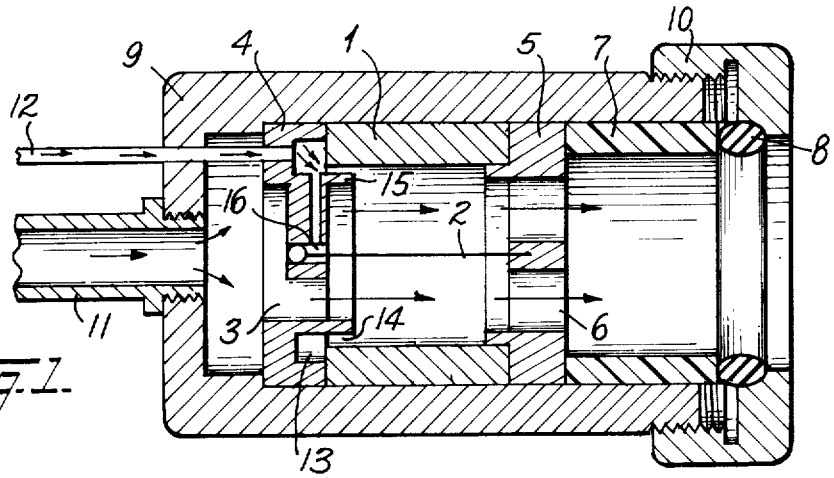
FIG. 1 shows diagrammatically a nozzle for the electrostatic spraying of powder products in accordance with the invention.

The nozzle as shown in FIG. 1 is a nozzle intended to be supplied with relatively weak high voltage, preferably between 4 and 10 kilovolts. The ionizing device used on this nozzle is one with cylindrical electrodes, comprising, as already known, an axial ionizing wire 2 given high voltage, through a strong protective resistance, by a lead not shown on the drawing, and a cylinder 1, conductive of electricity and earthed by an unshown lead, forming a conventional counter-electrode.

To prevent the formation, as in devices already known, of an insulating film of powder on the counter-electrode 1, the latter is made, in this aspect of the invention, of graphite or silicon. The applicants in fact discovered that, besides their already known properties, graphite and silicon had the unexpected property of being refractory to formation on their surface of an insulating layer due to friction of powder particles.

The outer cylinder 1 comprises, at its two extremities, insulating parts 4 and 5 provided with openings 3, 6 for the passage of the stream of powder mixed with its transport air. The parts 4 and 5 serve as support for the electrodes 2 and 1. An insulating cross-piece 7 is placed between part 5 and a metal ring 8. The purpose of the metal ring is to create the electric field between the nozzle and the object, which is designed to guide the charged powder particles towards the object. The ring 8 is electrically insulated, i.e., left unconnected; it acquires in this case an average potential several times higher than that provided by the high voltage. Parts 4, 1, 7 and 8 are adjusted inside an insulating cylindrical part 9 and blocked by means of an insulating nut 10.

The nozzle as shown in FIG. 1 comprises on its upper part an intake 11 of the incident mixture formed by the powder and its transport air, and also an intake 12 of secondary gas intended to sweep the electrodes. Tube 12 for the intake of secondary sweeping gas is linked to an annular cavity 13. The secondary gas contained in cavity 13 leaves on one hand by an annular axial exit 14 along the surface of the counter-electrode, sweeping it and thus, added to the effect of the graphite and silicon composing the counter-electrode, protecting it from any formation of insulating film; and leaves secondly through a channel 15 which crosses part 4 radially and joins an axial channel 16, which partially surrounds the threadlike electrode 2, thus enabling this to be swept by secondary gas.

Figure 2:
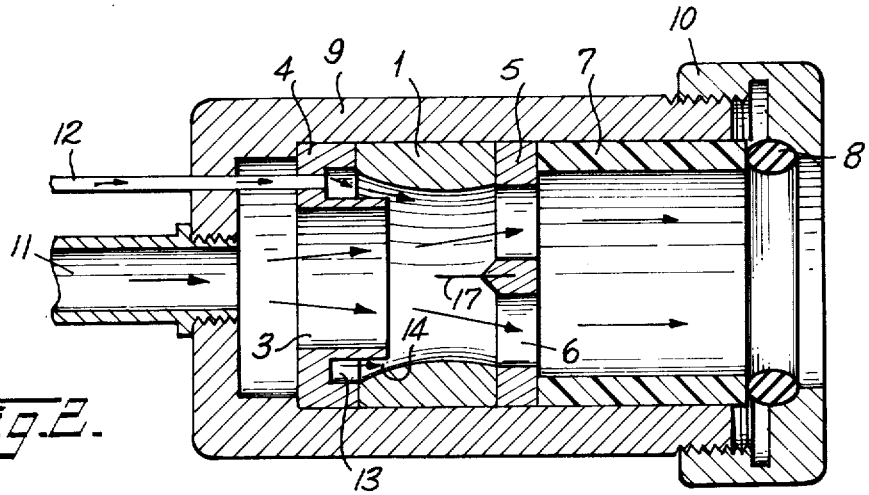
FIG. 2 shows diagrmmatically a variant of the nozzle construction as shown in FIG. 1.

The nozzle as shown in FIG. 2 differs from that in FIG. 1 essentially because of the fact that the ionizing axial wire is here replaced, as taught by Messrs. Truffaut and Hampe, by an ionizing metal needle 17 pointing in the opposite direction to the flow of powder particles. Such an arrangement has the advantage of making it unnecessary to sweep the said needle 17 with the stream of secondary gas. The other elements of FIG. 2 are practically identical to those of FIG. 1 and are referred to there by the same numerals. As an improvement, the counter-electrode 1 has, however, as shown on the drawing, a converging portion. This converging portion ensures a better impact of the stream of secondary sweeping gas on the part of the counter-electrode located at the level of the ionizing point, thus giving an even better guarantee that this place will be protected against the deposit of an insulating film.

Figure 3:
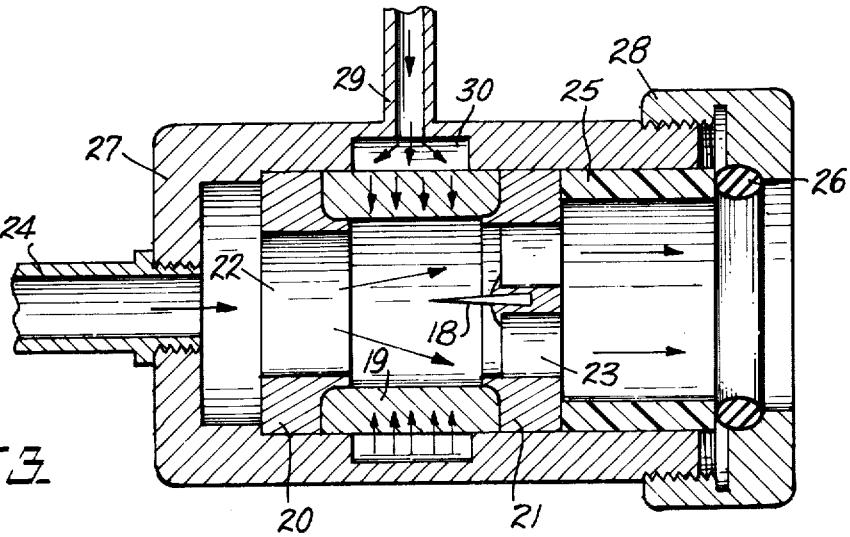
FIG. 3 shows diagrammatically another nozzle for the electrostatic spraying of powder products in accordance with the invention.

The nozzle diagrammatically shown in FIG. 3 is likewise a nozzle designed to be supplied with reduced high tension, preferably in the range of 4 to 10 kilovolts. The ionizing device used is similar to that in the nozzle as shown in FIG. 2 and so comprises an axial metal needle 18 given high voltage by an unshown lead and pointing against the flow of powder, and also an earthed annular metal electrode 19, acting as counter-electrode. The nozzle as shown in FIG. 3 comprises, as the nozzles of the previous figures:

insulating supporting parts 20 and 21 provided with openings 22 and 23 allowing the passage of the incident air-powder mixture, fed into the nozzle through intake tube 24, an insulating cross-piece 25 placed between insulating part 21 and a metal ring 26 insulated electrically, i.e., left unconnected, an insulating holding piece 27 and an insulating nut 28 for tightening together all the parts.

As another aspect of the invention, the earthed annular electrode 19 or "counter-electrode" is made of porous metal permeable to gases, such as, for example, that found commercially under the trademark PORAL.

Compressed secondary gas is brought, by tube 29, to an annular cavity 30 located between part 27 and the electrode 19. In this way, a stream of compressed gas is blown radially through porous electrode 19 towards electrode 18, thus sweeping away the powder particles which tend to be deposited on the inside surface of electrode 19 by the effect of the ionizing electric field.

The invention may be applied to all electrostatic powder-spraying nozzles designed to coat objets. It is particularly advantageous in electrostatic powder-coating nozzles which comprise an ionizing device functioning at a relatively low voltage.

What we claim is:

1. In a powder-ionizing nozzle for the electrostatic spraying of powder particles using a high voltage not greater than 10 kilovolts, said nozzle comprising a central electrode surrounded by a counter-electrode radially spaced therefrom, the improvement according to which said counter-electrode is made of an electrically conductive material permeable to gas and said nozzle comprises means for blowing a stream of auxiliary gas radially through said counter-electrode toward said central electrode.

2. Nozzle as claimed in claim 1 comprising at its outlet a third, electrically isolated electrode.

3. Nozzle as claimed in claim 1 in which said counter-electrode has a converging portion.

* * * * *